US011466944B1

(12) United States Patent
Serbu

(10) Patent No.: US 11,466,944 B1
(45) Date of Patent: Oct. 11, 2022

(54) FIREARM BOLT CARRIER GROUP

(71) Applicant: Mark Serbu, Tampa, FL (US)

(72) Inventor: Mark Serbu, Tampa, FL (US)

(73) Assignee: Serbu Firearms, Inc., a Florida corporation, Tampa, FL (US)

( * ) Notice: Subject to any disclaimer, the term of this patent is extended or adjusted under 35 U.S.C. 154(b) by 0 days.

(21) Appl. No.: 17/148,226

(22) Filed: Jan. 13, 2021

Related U.S. Application Data

(60) Provisional application No. 62/962,538, filed on Jan. 17, 2020.

(51) Int. Cl.
*F41A 3/26* (2006.01)
*F41A 3/28* (2006.01)
*F41A 3/30* (2006.01)

(52) U.S. Cl.
CPC ..... *F41A 3/28* (2013.01); *F41A 3/26* (2013.01); *F41A 3/30* (2013.01)

(58) Field of Classification Search
CPC ..... F41A 3/26; F41A 3/82
See application file for complete search history.

(56) References Cited

U.S. PATENT DOCUMENTS 3,318,192 A * 5/1967 Sullivan ..... F41A 3/82 89/142
4,191,089 A * 3/1980 Zedrosser ..... F41A 3/26 89/181
4,272,902 A * 6/1981 Waters ..... F41A 15/14 42/25
4,358,986 A * 11/1982 Giorgio ..... F41A 3/26 89/1.4
10,323,891 B1 * 6/2019 Zheng ..... F41A 3/88
2018/0224227 A1 * 8/2018 Durham, III ..... F41A 3/82
2020/0240734 A1 7/2020 Serbu
2021/0003357 A1 * 1/2021 Durham, III ..... F41A 3/82
2021/0048267 A1 * 2/2021 Abbott ..... F41A 3/16
2021/0156633 A1 * 5/2021 Durham, III ..... F41A 3/70

FOREIGN PATENT DOCUMENTS

WO WO-2021099132 A1 * 5/2021 ..... F41A 3/26

* cited by examiner

*Primary Examiner* — Gabriel J. Klein
(74) *Attorney, Agent, or Firm* — Foley & Lardner LLP

(57) ABSTRACT

A bolt carrier group for a firearm includes a bolt carrier, a bolt, and a cam pin. The bolt carrier includes a medial portion and a first and second outer portion. The bolt carrier slidably couples with a first elongated member at the first outer portion and a second elongated member at the second outer portion. The bolt is received within an inner volume of the bolt carrier. The cam pin is coupled with the bolt. The cam pin is positioned at least partially within the inner volume of the bolt carrier and extends through a top surface of the bolt carrier. The cam pin and the bolt are translatable and pivotable relative to the bolt carrier between a first position and a second position. The cam pin is configured to engage a recess of the second outer portion of the bolt carrier when in the first position.

17 Claims, 10 Drawing Sheets

FIREARM BOLT CARRIER GROUP

CROSS-REFERENCE TO RELATED PATENT APPLICATION

This application claims the benefit of and priority to U.S. Provisional Application No. 62/962,538, filed Jan. 17, 2020, the entire disclosure of which is incorporated by reference herein.

BACKGROUND

The present disclosure relates to firearms. More particularly, the present disclosure relates to bolt carrier groups for semi or fully automatic firearms.

SUMMARY

One implementation of the present disclosure provides for a bolt carrier group for a firearm. The bolt carrier group includes a bolt carrier, a bolt, and a cam pin. The bolt carrier includes a medial portion, a first outer portion, and a second outer portion. The bolt carrier is configured to slidably couple with a first elongated member at the first outer portion and a second elongated member at the second outer portion. The bolt is received within an inner volume of the bolt carrier. The cam pin is coupled with the bolt. The cam pin is positioned at least partially within the inner volume of the bolt carrier and extends through a top surface of the bolt carrier. The cam pin and the bolt are translatable and pivotable relative to the bolt carrier between a first position and a second position. The cam pin is configured to engage a recess of the second outer portion of the bolt carrier when in the first position.

Another implementation of the present disclosure provides for a firearm including a bolt carrier group. The bolt carrier group includes a bolt carrier, a bolt, and a camp pin. The bolt carrier has a medial portion, a first outer portion, and a second outer portion. The bolt carrier is configured to slidably couple with a first elongated member at the first outer portion and a second elongated member at the second outer portion. The bolt is received within an inner volume of the bolt carrier. The cam pin is coupled with the bolt, and is positioned at least partially within the inner volume of the bolt carrier and extends through a top surface of the bolt carrier. The cam pin and the bolt are translatable and pivotable relative to the bolt carrier between a first position and a second position. The cam pin is configured to engage a recess of the second outer portion of the bolt carrier when in the first position.

Another implementation of the present disclosure provides for a bolt carrier group for a firearm. The bolt carrier group includes a bolt carrier, a bolt, and a cam pin. The bolt carrier is configured to slidably couple with a first elongated member at the first outer portion and a second elongated member at the second outer portion. The bolt is received within an inner volume of the bolt carrier. The cam pin is coupled with the bolt. The cam pin and the bolt are translatable and pivotable relative to the bolt carrier between a first position and a second position. The cam pin is configured to interlock with a recess of the second outer portion of the bolt carrier when in the first position at an orientation different than an orientation of the cam pin when in the second position.

This summary is illustrative only and is not intended to be in any way limiting. Other aspects, inventive features, and advantages of the devices or processes described herein will become apparent in the detailed description set forth herein, taken in conjunction with the accompanying figures, wherein like reference numerals refer to like elements.

BRIEF DESCRIPTION OF THE DRAWINGS

The disclosure will become more fully understood from the following detailed description, taken in conjunction with the accompanying figures, wherein like reference numerals refer to like elements, in which.

DETAILED DESCRIPTION

Figure 1:
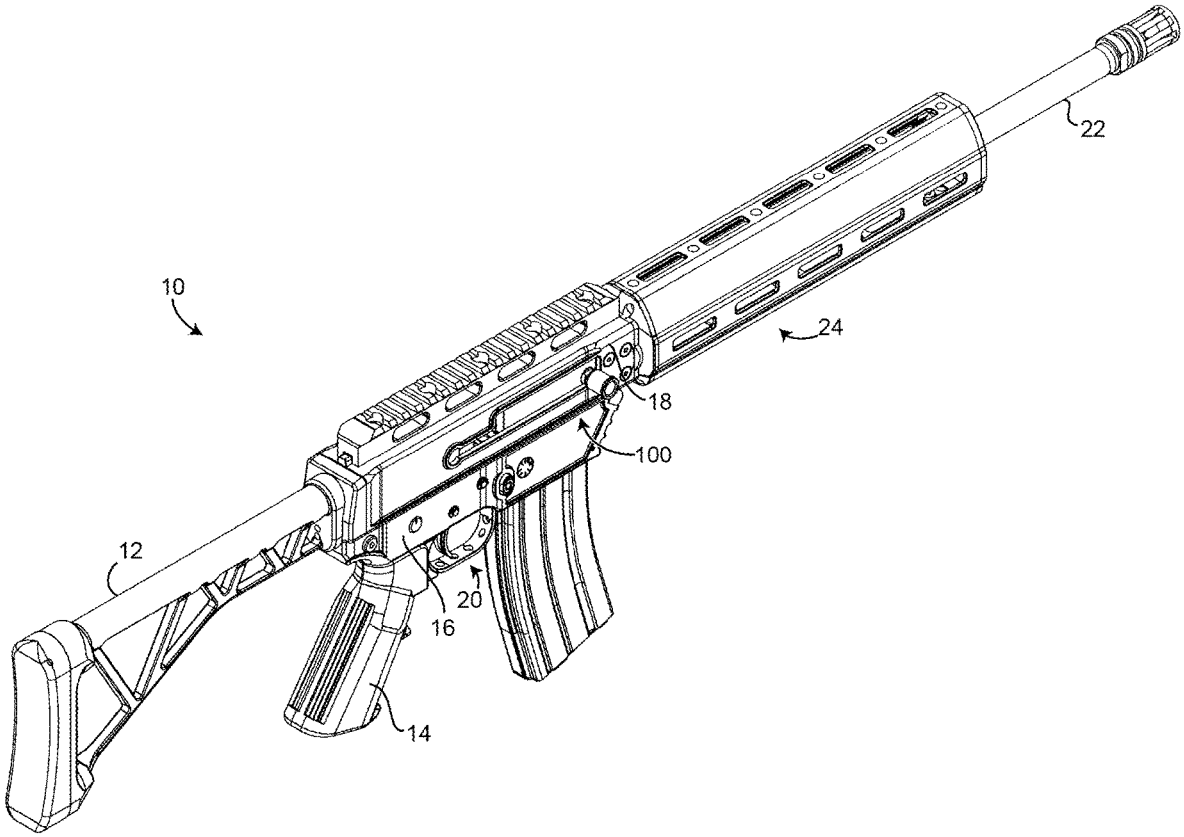
FIG. 1 is an isometric view of a firearm, according to an exemplary embodiment.
Figure 2:
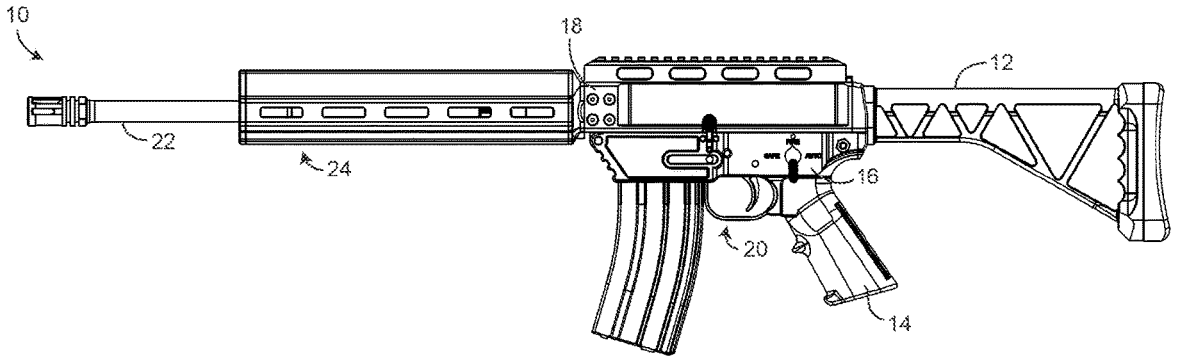
FIG. 2 is a side view of the firearm of FIG. 1.
Figure 3:
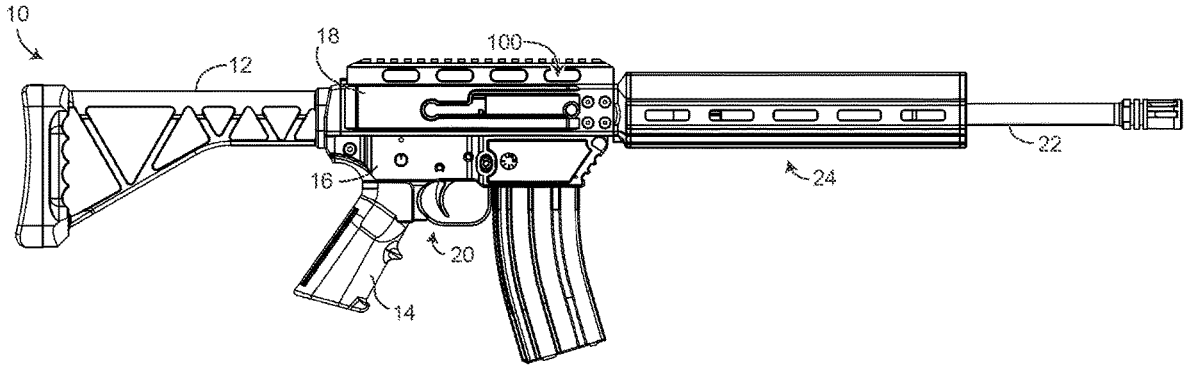
FIG. 3 is a side view of the firearm of FIG. 1.
Figure 4:
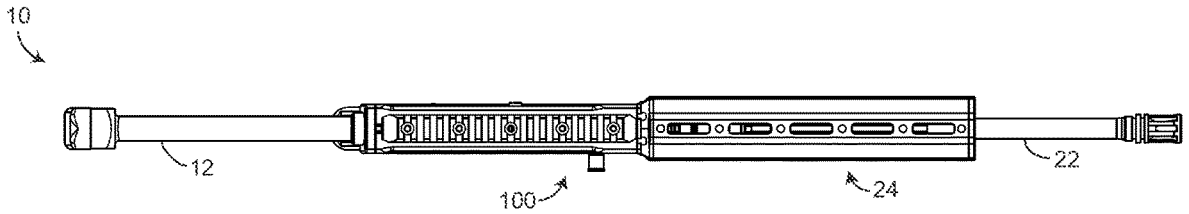
FIG. 4 is a top view of the firearm of FIG. 1.

Before turning to the figures, which illustrate the exemplary embodiments in detail, it should be understood that the present disclosure is not limited to the details or methodology set forth in the description or illustrated in the figures. It should also be understood that the terminology used herein is for the purpose of description only and should not be regarded as limiting.

Overview

Referring generally to the figures, a semi-automatic or full-automatic firearm in which a bolt carrier group cycles fore and aft on guide rods is shown, according to various embodiments. The bolt carrier group includes a cam pin that is oriented vertically or substantially vertically in a bolt carrier, and a bolt assembly includes a bolt head (e.g., a bolt head directly from an M-16/AR-15). A compact cam pin guide may be located above and between the guide rods. In some embodiments, the cam pin guide is attached to a scope rail which provides sufficient structural support even if a receiver of the firearm is a lightweight alloy, composite or plastic. To provide clearance for the cam pin to move in rotation along with the bolt head, a notch is machined into one (or both) of the guide rods. In some embodiments, the notch runs nearly the full length of the guide rod and may be repeated at two or more positions in rotation, thereby defining flutes which reduce the weight of the guide rods and decrease drag on the bolt carrier. In some embodiments, the design and/or location of the cam pin and/or the location of the guide rods provide cam pin clearance without requiring notching or fluting.

In various conventional firearm designs, a bolt carrier group translates or moves fore and aft on rails or channels that are machined into a receiver, or in an inner diameter of a tubular receiver. In contrast, by having the bolt carrier group translate or reciprocate on guide rods, there is no requirement for a precision machined receiver. In addition, the receiver of the firearm may be manufactured from lightweight alloy or materials such as composite or plastic that do not have the strength or wear resistance for the bolt to cycle in directly, as may be the case if the guide rods are not used.

Additionally, in various conventional firearms, the cam pin (which moves along a cam path cut into the bolt carrier in order to rotate and lock the bolt head into the barrel extension or receiver) is oriented out of the side of the bolt carrier. This may be because there generally is neither room between the guide rods for the cam pin guide nor clearance for the cam pin to rotate. Additionally, although other firearms which use guide rods have bolt heads which are direct descendants, or at least have a lineage to, the M-16/AR-15, they are almost all different from one another and lack part commonality.

Advantageously, the firearm and the bolt carrier group described herein use guide rods which may be notched, fluted, or positioned to provide sufficient clearance for the cam pin to be positioned within the bolt carrier. Advantageously, this facilitates improved part commonality and reduces the need for a precision machined receiver.

Firearm

Referring to FIGS. 1-7, a firearm 10 is shown, according to an exemplary embodiment. The firearm 10 can be a semi-automatic firearm (e.g., a semi-automatic rifle) or a fully-automatic firearm (e.g., a fully-automatic rifle). It should be understood that the firearm 10 can be any other style of firearm and the example shown in FIGS. 1-7 should not be understood to be limiting.

The firearm 10 includes a stock 12, a grip 14 (e.g., a pistol grip, a hand grip, etc.), a lower receiver 16, and upper receiver 18, a trigger assembly 20, and a barrel 22. The firearm 10 also includes a handguard 24 (e.g., a grasping portion, a sleeve portion, a grip, etc.) through which the barrel 22 extends. The firearm 10 also includes a bolt carrier group 100 (e.g., a bolt carrier system, a bolt carrier assembly, etc.) that is positioned within the firearm 10 (e.g., partially within the upper receiver 18 and/or the lower receiver 16). The firearm 10 may be operated by placing the stock 12 against a user's shoulder and through operation of a trigger of the trigger assembly 20. The handguard 24 may provide a surface for steadying and aiming the firearm 10 (e.g. being grasped with a user's hand). The firearm 10 can be an M-16 and/or an AR-15 rifle.

Bolt Carrier Group

Figure 8:
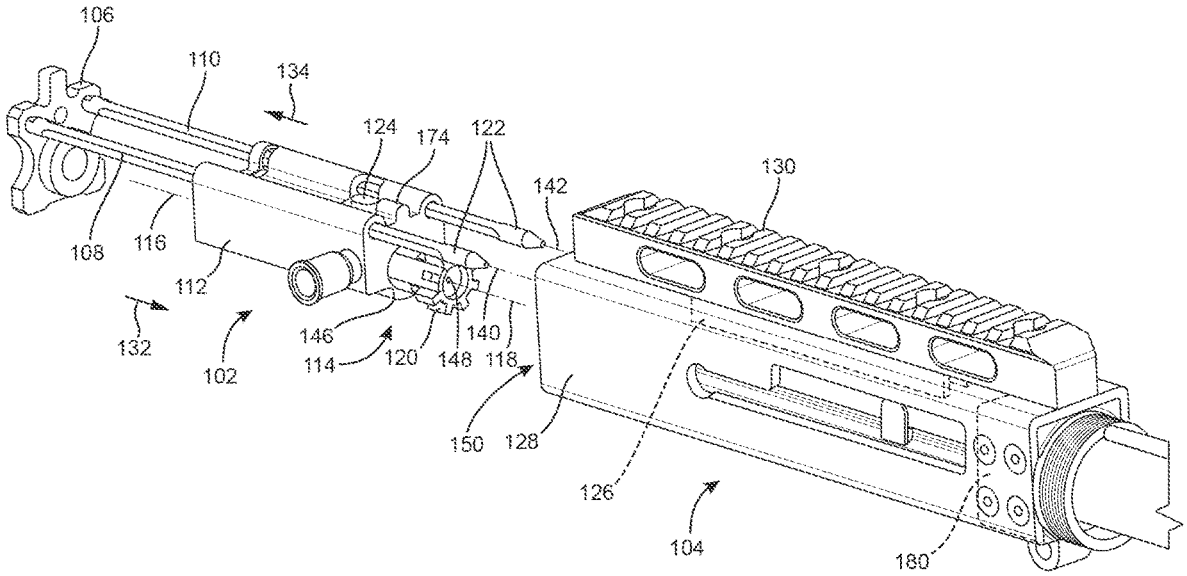
FIG. 8 is a perspective view of a bolt carrier group for use with the firearm of FIGS. 1-7, including a bolt carrier, a first and second guide rod, a bolt, and a cam pin, according to some embodiments.

Referring particularly to FIG. 8, a portion of the firearm 10 (e.g., a rifle) is shown, according to some embodiments. Firearm 10 may include the bolt carrier group 100 (e.g., a bolt carrier system, a bolt carrier assembly, etc.), and a receiver assembly 104 (e.g., the upper receiver 18). In some embodiments, bolt carrier group 100 is configured for use with a semi-automatic or a fully-automatic firearm 10. For example, bolt carrier group 100 may be configured for use in a semi-automatic rifle.

Bolt carrier group 100 includes a carrier sub-assembly 102 (e.g., a carrier assembly, a bolt carrier group, a sub-assembly, etc.), that is configured to translate, move, reciprocate, slide, etc., along a first guide rod 108 (e.g., a first elongated member, a first cylindrical member, a first rod, a rail, etc.) and a second guide rod 110 (e.g., a second elongated member, a second cylindrical member, a second rod, a rail, etc.). First guide rod 108 defines a first longitudinal guide axis 140, and second guide rod 110 defines a second longitudinal guide axis 142. First longitudinal guide axis 140 and second longitudinal guide axis 142 may be parallel with each other. First guide rod 108 and second guide rod 110 may be fixedly coupled with a structural member, a plate, a rear member, etc., shown as structural member 106. Structural member 106 can include openings, apertures, holes, windows, etc., through which first guide rod 108 and second guide rod 110 extend. First guide rod 108 and second guide rod 110 may be, for example, press fit, slip fit, fastened, attached, integrally formed, etc., or otherwise fixedly coupled with structural member 106. In some embodiments, first guide rod 108 and second guide rod 110 include chamfered ends 122. In some embodiments, first guide rod 108 and second guide rod 110 are fixedly coupled at a first end with structural member 106, and at a second, distal, or opposite end, with a structural member 180 of receiver assembly 104. Structural member 180 of receiver assembly 104 may include openings, apertures, connection portions, windows, holes, bores, etc., configured to receive the second, distal, or opposite ends of first guide rod 108 and second guide rod 110 to fixedly couple and support first guide rod 108 and second guide rod 110.

Carrier sub-assembly 102 can be a sub-assembly of bolt carrier group 100. Carrier sub-assembly 102 includes a bolt carrier 112 (e.g., a carrier, a translatable member, a body member, a carriage, etc.), a bolt 120, and a cam pin 124. Bolt 120 and cam pin 124 may cooperatively define a bolt sub-assembly 114 and rotate, pivot, and/or translate in unison. Carrier sub-assembly 102 can be translatable along first guide rod 108 and second guide rod 110 of bolt carrier group 100. In some embodiments, carrier sub-assembly 102 is configured to reciprocate along first guide rod 108 and second guide rod 110. For example, carrier sub-assembly 102 may be configured to translate in a first direction, a forwards direction, a fore direction, etc., shown as first direction 132, and a second direction, a rearwards direction, an aft direction, etc., shown as second direction 134. Carrier sub-assembly 102 is configured to translate along first guide rod 108 and second guide rod 110 in first direction 132 and/or second direction 134 during operation of the firearm 10 for loading and firing of cartridges, and ejection of bullet casings. Carrier sub-assembly 102 may be configured to translate in first direction 132 to facilitate loading of cartridges, and to translate in second direction 134 to facilitate ejection of bullet casings. In some embodiments, carrier sub-assembly 102 is driven to translate in second direction 134 by a gas system of the firearm 10 or by an inertia system of firearm 10. For example, gases produced by igniting a propellant (e.g., gunpowder) of the cartridge may be redirected and used to translate carrier sub-assembly 102 in second direction 134.

In some embodiments, a central axis, a centerline, etc., shown as carrier axis 116 extends through bolt carrier 112. In the embodiment shown in FIG. 8, carrier axis 116 is parallel with first longitudinal guide axis 140 and second longitudinal guide axis 142.

The firearm 10 may include a trigger assembly (e.g., trigger assembly 20) and a firing assembly, or various sub-assemblies or components to facilitate the firing of projectiles (e.g., bullets) by igniting propellants of cartridges (e.g., 5.56 ammunition). For example, a firing pin may be positioned within bolt 120, and extend through an opening, a hole, a central aperture, a window, etc., shown as aperture 148 of bolt 120. The firing pin can be configured to translate into contact with a primer of the cartridge to ignite the propellant of the cartridge to fire the projectile. The trigger assembly can include a trigger and operation of the trigger (e.g., by a user of the firearm 10) facilitates driving the firing pin into contact with the primer of the cartridge.

In the embodiment shown in FIGS. 8-14, bolt 120 is received within an aperture, an opening, a hole, a window, etc., of bolt carrier 112 shown as bolt opening 146. Bolt opening 146 has a cross-sectional shape that corresponds to an outer periphery, an outer shape, an outer surface, etc., of bolt 120. Bolt 120 is translatable through bolt opening 146 for operation of loading cartridges, firing projectiles, and ejecting cartridge casings. Bolt opening 146 may extend through a lateral surface 160 of bolt carrier 112 (shown in FIG. 9). A central axis, a longitudinal axis, a centerline, etc., shown as bolt centerline 118 extends through bolt 120. Bolt centerline 118 may be parallel with carrier axis 116. In the embodiment shown in FIGS. 8-14, bolt centerline 118 is also parallel with both first longitudinal guide axis 140 and second longitudinal guide axis 142. Bolt 120 may translate in second direction 134 or first direction 132 relative to bolt carrier 112. Bolt 120 is configured to translate in second direction 134 and rotate about bolt centerline 118. For example, bolt 120 may translate rearwards relative to bolt carrier 112 (e.g., translate in second direction 134) and then rotate about bolt centerline 118 to lock bolt 120 in a rearwards position (e.g., through engagement of cam pin 124 and recess 170 as described herein).

Bolt carrier group 100 includes a cam pin guide, a guide member, a rail member, etc., shown as cam pin guide 126. Cam pin guide 126 may be positioned within an inner volume 150 of a receiver 128 of receiver assembly 104. In some embodiments, cam pin guide 126 is an elongated member with a cross-sectional shape for receiving and guiding cam pin 124 along cam pin guide 126. Cam pin guide 126 extends in a direction or along a longitudinal axis that is parallel with any of carrier axis 116, bolt centerline 118, first longitudinal guide axis 140, or second longitudinal guide axis 142.

Figure 9:
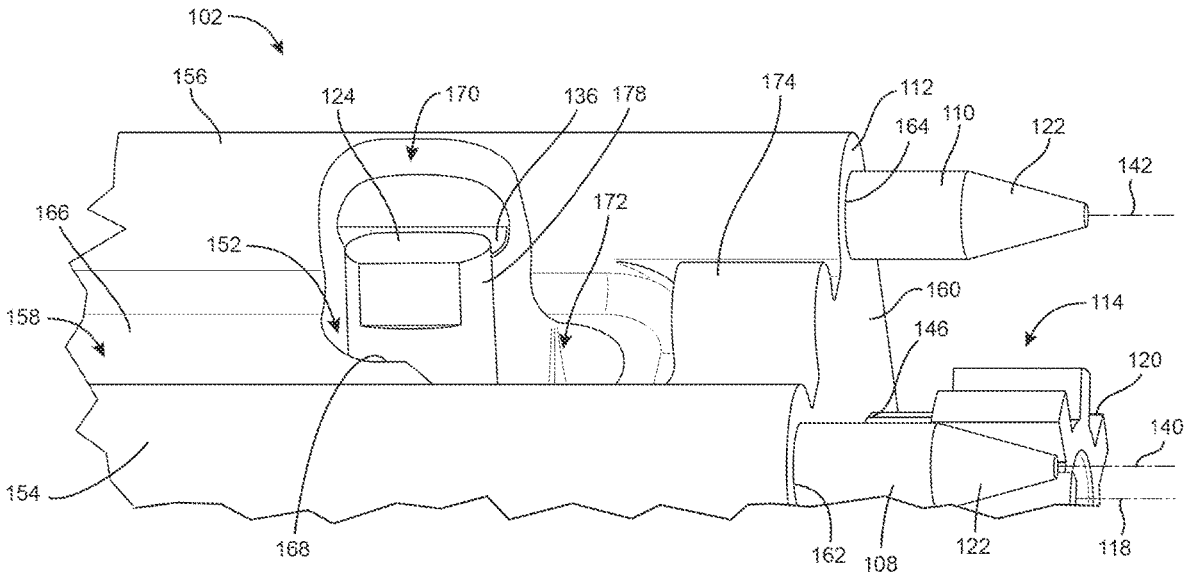
FIG. 9 is a perspective view of a portion of the bolt carrier group of FIG. 8.

Referring particularly to FIG. 9, bolt carrier 112 of FIG. 8 is shown in greater detail. Bolt carrier 112 includes a first portion, a first side portion, a right lateral portion, a right portion, etc., shown as first portion 154, a central portion, a main portion, a body, a medial portion, etc., shown as medial portion 158, and a second portion, a second side portion, a left lateral portion, a left portion, etc., shown as second portion 156. Medial portion 158 is positioned between first portion 154 and second portion 156. In some embodiments, first portion 154, second portion 156, and medial portion 158 are integrally formed with each other.

First guide rod 108 may extend through a first opening, a first aperture, a first passage, a first channel, a first bore, a first hole, etc., shown as first bore 162. In some embodiments, first bore 162 extends in a direction that is co-axial with first longitudinal guide axis 140. Second guide rod 110 may extend through a second opening, a second aperture, a second passage, a second channel, a second bore, a second hole, etc., shown as second bore 164. Second bore 164 may be parallel with first bore 162 as shown in FIGS. 8-14. For example, first bore 162 and second bore 164 may both extend in parallel directions through first portion 154 and second portion 156 of bolt carrier 112. Bolt carrier 112 translates along first guide rod 108 and second guide rod 110 which extend through first bore 162 and second bore 164 of bolt carrier 112. In some embodiments, first guide rod 108 defines or extends through a laterally right or first side of bolt carrier 112. Likewise, second guide rod 110 may define or extend through a laterally left or second side of bolt carrier 112.

Bolt carrier 112 includes an inner volume, a space, an opening, etc., shown as inner volume 152. Inner volume 152 may extend through medial portion 158 and at least one of first portion 154 or second portion 156. Inner volume 152 is configured to receive cam pin 124 therethrough. In some embodiments, inner volume 152 is cut (e.g., milled) into bolt carrier 112 and defines a cam path for cam pin 124. Cam pin 124 can extend through inner volume 152 and may translate and/or rotate along inner volume 152. Inner volume 152 may define a cam path for cam pin 124. Inner volume 152 extends through an exterior or top surface 166 of medial portion 158. In this way, cam pin 124 may extend outwards through top surface 166 of medial portion 158 and at least a portion of first portion 154 or second portion 156. Inner volume 152 may facilitate the translation and rotation of cam pin 124 along the cam path so that cam pin 124 may translate and rotate/pivot into engagement with second guide rod 110 (or first guide rod 108).

Inner volume 152 and bolt opening 146 cooperatively form a cavity, an inner volume, a void, etc., of bolt carrier 112. Cam pin 124 and bolt 120 may extend through the bolt opening 146 and inner volume 152 of bolt carrier 112. In some embodiments, bolt 120 and cam pin 124 are fixedly coupled, attached, fastened, or integrally formed with each other. For example, bolt 120 and cam pin 124 may translate in second direction 134 relative to bolt carrier 112. Bolt 120 and cam pin 124 slidably couple with an interior surface of bolt carrier 112. Cam pin 124 may engage, contact, be guided by, etc., an interior surface 168 of inner volume 152. As cam pin 124 and bolt 120 translate in second direction 134 relative to bolt carrier 112, cam pin 124 is guided along interior surface 168 into engagement with a groove, a recess, a channel, etc., shown as recess 170 of second portion 156. Cam pin 124 travels along its cam path along inner volume 152 into engagement with recess 170 of second portion 156 when bolt 120 and cam pin 124 translate in second direction 134. As cam pin 124 translates in second direction 134, the engagement between cam pin 124 and the interior surface 168 may guide cam pin 124 and bolt 120 to rotate or pivot about bolt centerline 118 so that cam pin 124 pivots or rotates into engagement with recess 170 of second portion 156.

Figure 10:
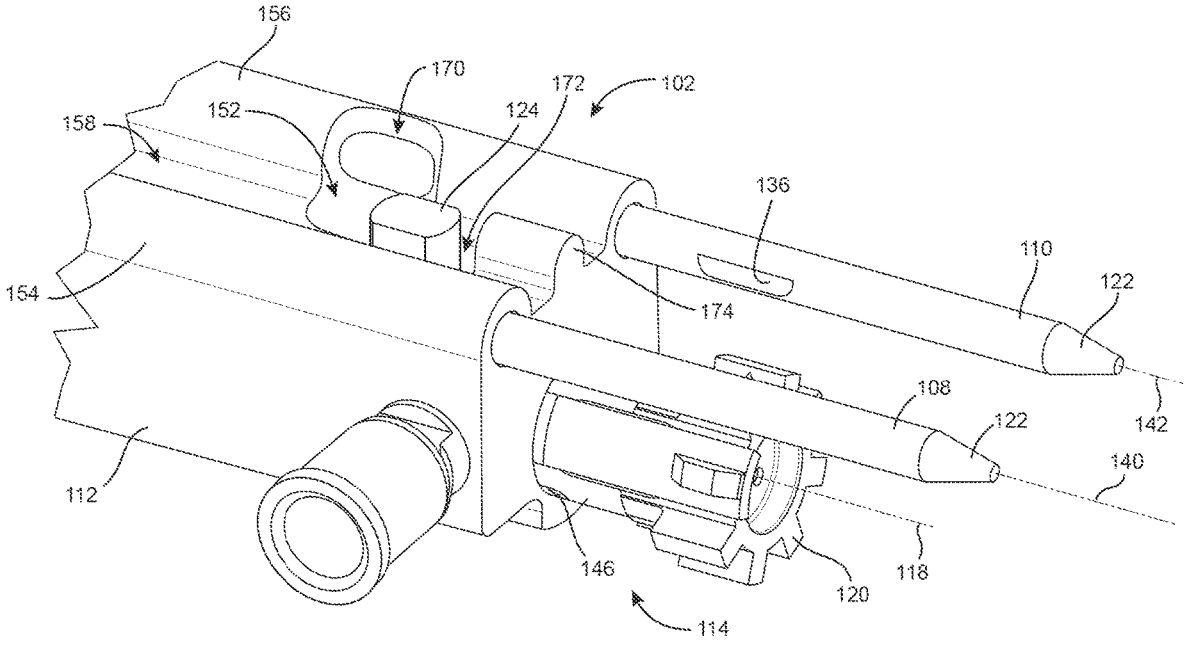
FIG. 10 is another perspective view of a portion of the bolt carrier group of FIG. 8.
Figure 11:
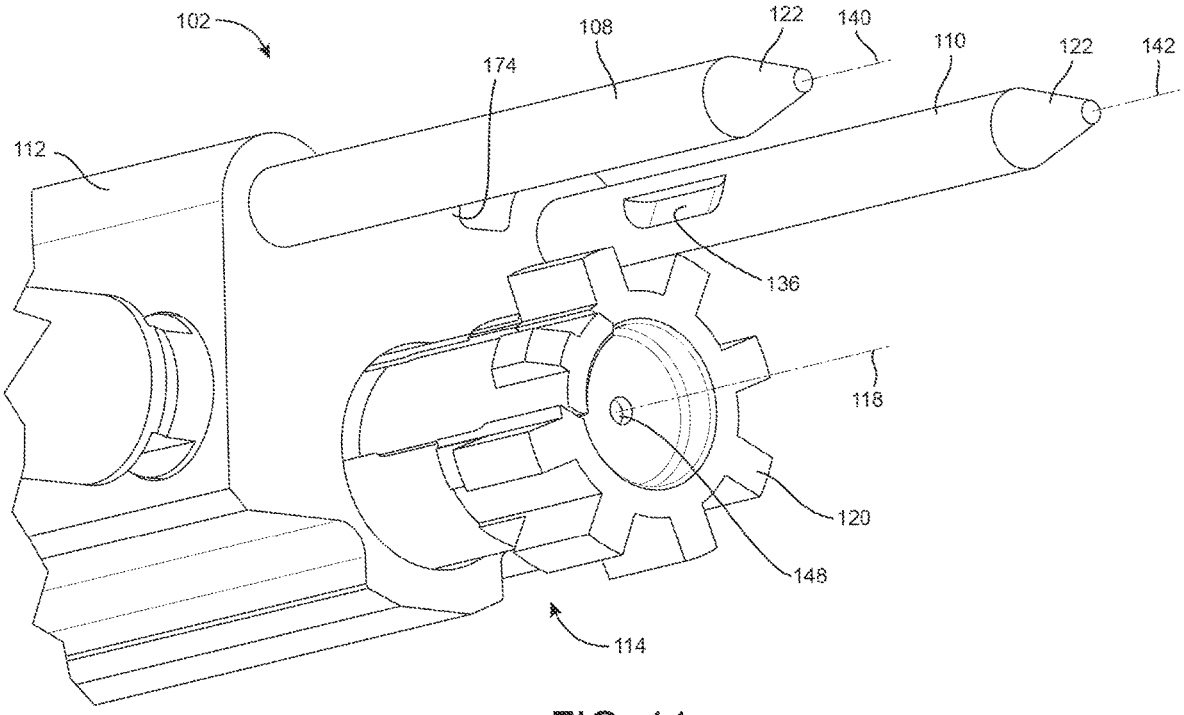
FIG. 11 is another perspective view of a portion of the bolt carrier group of FIG. 8.

In some embodiments, second guide rod 110 includes a groove, a recess, a slot, etc., shown as notch 136 in FIGS. 9-11. Notch 136 may be positioned along second guide rod 110 so that the recess 170 of second portion 156 matches, aligns with, etc., notch 136 when bolt carrier 112 is at a particular position along second guide rod 110 and first guide rod 108. In some embodiments, notch 136 includes a shape that corresponds to a shape of cam pin 124 so that cam pin 124 is received within notch 136 and interlocks with second guide rod 110 through notch 136.

Cam pin 124 and bolt 120 are transitionable between a first position and a second position. For example, cam pin 124 and bolt 120 may be translatable and pivotable between a first position when cam pin 124 is at a rearwards position along bolt carrier 112 and interlocks with second guide rod 110 through notch 136 (as shown in FIG. 9) and a second position when cam pin 124 is at a forwards position along bolt carrier 112. When cam pin 124 is at the forwards position along bolt carrier 112, cam pin 124 rests within, is positioned at, etc., a groove 172 (e.g., a first portion, a forwards portion, etc.) at a forwards end of inner volume 152 of bolt carrier 112 (as shown in FIG. 10).

Notch 136 facilitates pivoting or rotation of cam pin 124 into engagement with recess 170 so that second guide rod 110 does not obstruct engagement between cam pin 124 and recess 170. In this way, notch 136 may facilitate providing clearance for cam pin 124 so that cam pin 124 can sufficiently engage bolt carrier 112 at recess 170. In some embodiments, second guide rod 110 is spaced apart relative to first guide rod 108 a distance 144 (shown in FIG. 14) so that second guide rod 110 does not obstruct engagement or interlocking between cam pin 124 and recess 170 or to facilitate providing clearance for cam pin 124 to engage bolt carrier 112 at recess 170. In this way, a groove, a notch, etc., shown as recess 170 in FIGS. 9-10, may be formed in bolt carrier 112 that receives cam pin 124 and locks cam pin 124 and bolt 120 in the rearwards position (shown in FIG. 9). Recess 170 extends through an entire wall thickness of second portion 156 so that notch 136 is accessible by cam pin 124 through recess 170.

Bolt carrier 112 is translatable between a first position along first guide rod 108 and second guide rod 110 so that recess 170 and notch 136 are aligned with each other (as shown in FIG. 9) and a second position along first guide rod 108 and second guide rod 110 so that recess 170 and notch 136 are not aligned (as shown in FIG. 10).

Figure 12:
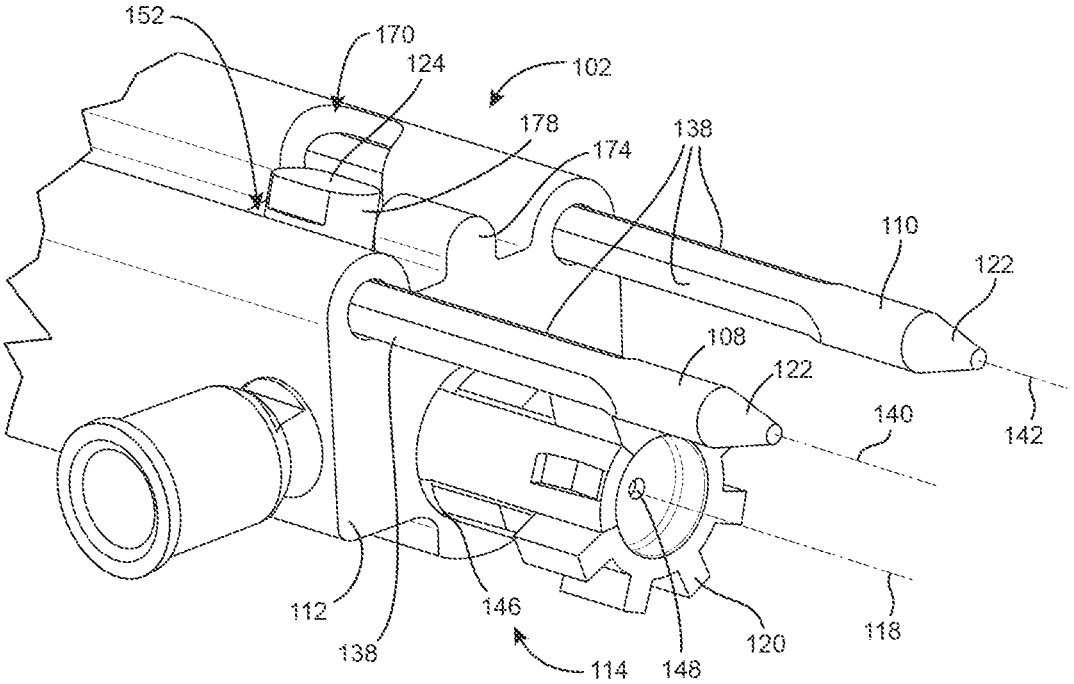
FIG. 12 is another perspective view of a portion of the bolt carrier group of FIG. 8.
Figure 13:
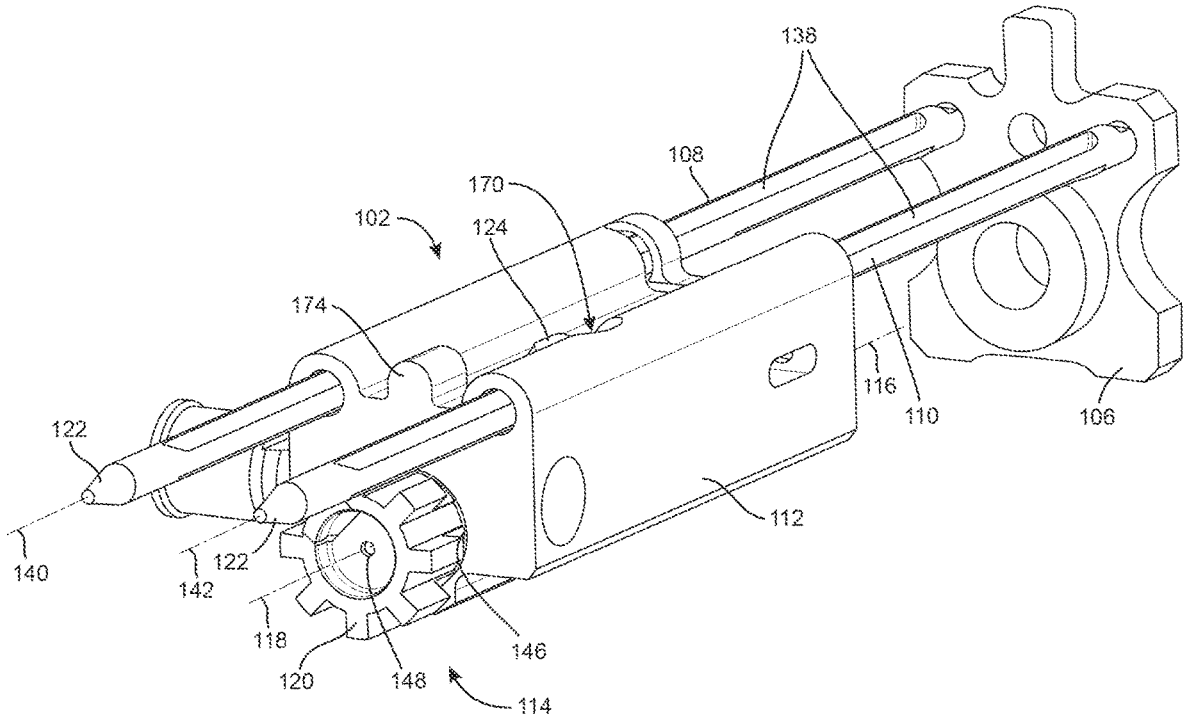
FIG. 13 is another perspective view of a portion of the bolt carrier group of FIG. 8.

Referring particularly to FIGS. 12 and 13, first guide rod 108 and second guide rod 110 may include flutes, channels, grooves, notches, etc., that extend along substantially an entire length of guide rods 108-110, shown as flutes 138. In the embodiment shown in FIGS. 12 and 13, first guide rod 108 and second guide rod 110 are symmetrical and each include multiple flutes 138. For example, each of first guide rod 108 and second guide rod 110 may include three, two, or a single flute 138. The flutes 138 extend along first guide rod 108 and second guide rod 110 so that cam pin 124 can be received within and interlock with recess 170 of bolt carrier 112.

Figure 5:
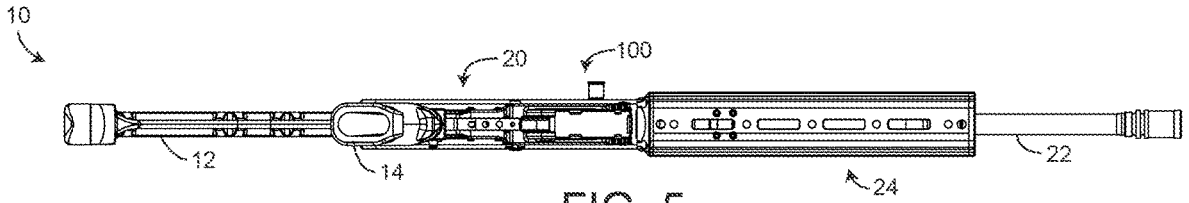
FIG. 5 is a bottom view of the firearm of FIG. 1.
Figure 6:
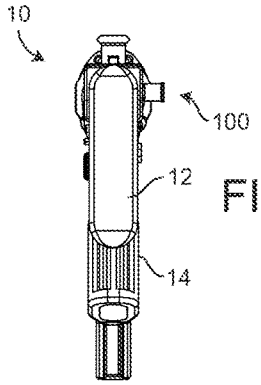
FIG. 6 is a rear view of the firearm of FIG. 1.
Figure 7:
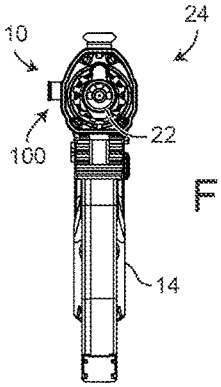
FIG. 7 is a front view of the firearm of FIG. 1.

Flutes 138 facilitate providing additional clearance for cam pin 124 to engage, interlock with, removably couple with, etc., bolt carrier 112 through recess 170. Flutes 138 may extend along an entire overall length of first guide rod 108 and second guide rod 110 or substantially the entire overall length of first guide rod 108 and second guide rod 110 as shown in FIGS. 5-7. In other embodiments, flutes 138 extend along only a portion of the entire overall length of first guide rod 108 and second guide rod 110. Flutes 138 may be uniform for both first guide rod 108 and second guide rod 110. In this way, first guide rod 108 and second guide rod 110 may be uniform parts or elongated members that are positioned apart from each other. Advantageously, if flutes 138 are uniform, this may reduce the need to manufacture a "left" and "right" side guide rod member.

Referring generally to FIGS. 8-14, bolt carrier 112 may include a protrusion, a guide member, etc., shown as protrusion 174. Protrusion 174 is configured to be received within cam pin guide 126. Cam pin guide 126 may be fixedly coupled with and positioned within receiver 128 and can receive cam pin 124 therewithin. When bolt carrier 112 translates along first guide rod 108 and second guide rod 110 in first direction 132, cam pin 124 may be driven out of engagement with recess 170 as cam pin 124 is received within cam pin guide 126. Cam pin 124 can include a chamfered or rounded surface 178 that is configured to facilitate guidance of cam pin 124 into an inner volume, track, or channel 176 of cam pin guide 126. As bolt carrier 112 translates in first direction 132 (towards cam pin guide 126), cam pin 124 may be guided by cam pin guide 126 so that bolt 120 and cam pin 124 pivot out of engagement with recess 170, and so that bolt 120 and cam pin 124 pivot and translate to groove 172 at the forwards position of inner volume 152 of bolt carrier 112. Cam pin 124 may remain at the forwards position at groove 172 of inner volume 152 of bolt carrier 112 as bolt carrier 112, bolt 120, and cam pin 124 translate along guide rods 108-110.

Figure 14:
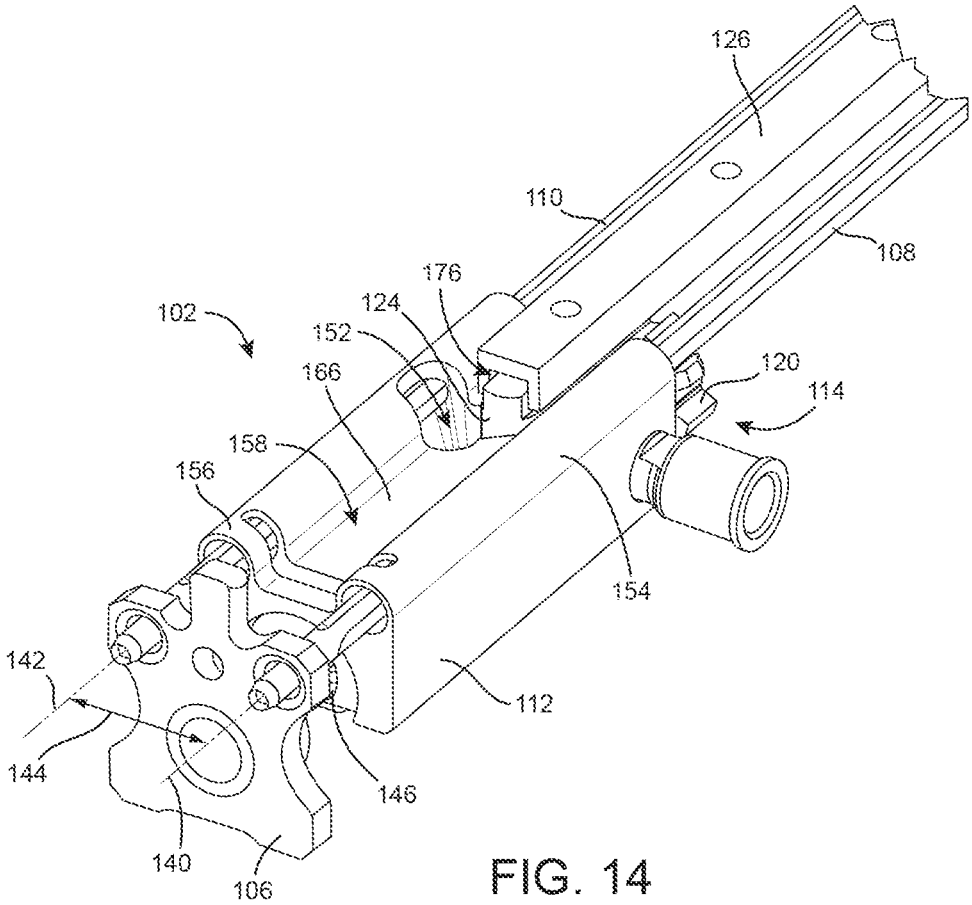
FIG. 14 is another perspective view of a portion of the bolt carrier group of FIG. 8, showing the cam pin received within a cam pin guide.

Referring particularly to FIG. 14, cam pin guide 126 may be positioned so that cam pin guide 126 extends over medial portion 158 of bolt carrier 112. Cam pin guide 126 extends over top surface 166 of medial portion 158 of bolt carrier 112. Cam pin guide 126 extends over inner volume 152 of bolt carrier 112. In this way, cam pin 124 may extend out of inner volume 152 past top surface 166 of medial portion 158 of bolt carrier 112 and be received within channel 176 of cam pin guide 126. In some embodiments, cam pin guide 126 extends in a direction that is parallel with first guide rod 108 and/or second guide rod 110 (e.g., parallel with first longitudinal guide axis 140 and/or second longitudinal guide axis 142). Cam pin guide 126 can be positioned between first guide rod 108 and second guide rod 110. Cam pin guide 126 is configured to receive protrusion 174 of bolt carrier 112 within channel 176 as bolt carrier 112 translates along first guide rod 108 and second guide rod 110 (e.g., in first direction 132).

Referring again to FIG. 8, cam pin guide 126 may be fixedly coupled, attached, secured, fastened, etc., with a scope rail 130 of receiver assembly 104. In some embodiments, cam pin guide 126 is fixedly coupled with receiver 128. Advantageously, fixedly coupling cam pin guide 126 with scope rail 130 of receiver assembly 104 may facilitate sufficient structural support for cam pin guide 126 even if receiver 128 is a lightweight alloy, a composite, or a plastic. In some embodiments, cam pin guide 126 is fixedly coupled with or supported by structural member 180 of receiver assembly 104.

Advantageously, carrier sub-assembly 102 uses first guide rod 108 and second guide rod 110, along which bolt carrier 112 may translate (e.g., fore and aft). Using first guide rod 108 and second guide rod 110 may reduce a need for a precisely machined receiver 128. Other bolt carrier assemblies include channels, grooves, or tracks machined into the receiver, which may be difficult or costly from a manufacturing and quality control perspective. However, the bolt carrier group described herein uses first guide rod 108 and second guide rod 110, thereby enabling receiver 128 to be a lightweight composite, a plastic, or a lightweight alloy, and reducing the machining requirements of receiver 128. Contact or wear may occur between the bolt carrier 112 and the guide rods 108-110 instead of between the bolt carrier 112 and the receiver 128, thereby facilitating using a lightweight plastic, alloy, composite, etc., material for receiver 128.

Another advantage of carrier sub-assembly 102 is that the cam pin 124 is positioned within the bolt carrier 112 and protrudes or extends past top surface 166 of bolt carrier 112 between the first guide rod 108 and the second guide rod 110. Orienting cam pin 124 vertically or substantially vertically within bolt carrier 112 facilitates improved part commonality across various rifles or firearms. For example, the bolt 120 used in carrier sub-assembly 102 may be substantially the same as or similar to a bolt used in a bolt carrier group that uses tracks machined into the receiver. Advantageously, carrier sub-assembly 102 facilitates using the same bolts and/or cam pins for both a rail or rod based assembly (i.e., carrier sub-assembly 102) and for an assembly where tracks are machined into the receiver. The bolt carrier 112 and/or the bolt 120 can include or be manufactured from a steel material.

Configuration of Exemplary Embodiments

As utilized herein, the terms "about," "substantially," and similar terms are intended to have a broad meaning in harmony with the common and accepted usage by those of ordinary skill in the art to which the subject matter of this disclosure pertains. It should be understood by those of skill in the art who review this disclosure that these terms are intended to allow a description of certain features described and claimed without restricting the scope of these features to the precise numerical ranges provided. Accordingly, these terms should be interpreted as indicating that insubstantial or inconsequential modifications or alterations of the subject matter described and claimed are considered to be within the scope of the disclosure as recited in the appended claims.

It should be noted that the term "exemplary" and variations thereof, as used herein to describe various embodiments, are intended to indicate that such embodiments are possible examples, representations, and/or illustrations of possible embodiments (and such terms are not intended to connote that such embodiments are necessarily extraordinary or superlative examples).

The term "coupled," as used herein, means the joining of two members directly or indirectly to one another. Such joining may be stationary (e.g., permanent or fixed) or moveable (e.g., removable or releasable). Such joining may be achieved with the two members coupled directly to each other, with the two members coupled to each other using a separate intervening member and any additional intermediate members coupled with one another, or with the two members coupled to each other using an intervening member that is integrally formed as a single unitary body with one of the two members. Such members may be coupled mechanically, electrically, and/or fluidly.

The term "or," as used herein, is used in its inclusive sense (and not in its exclusive sense) so that when used to connect a list of elements, the term "or" means one, some, or all of the elements in the list. Conjunctive language such as the phrase "at least one of X, Y, and Z," unless specifically stated otherwise, is understood to convey that an element may be either X, Y, Z; X and Y; X and Z; Y and Z; or X, Y, and Z (i.e., any combination of X, Y, and Z). Thus, such conjunctive language is not generally intended to imply that certain embodiments require at least one of X, at least one of Y, and at least one of Z to each be present, unless otherwise indicated.

References herein to the positions of elements (e.g., "top," "bottom," "above," "below," etc.) are merely used to describe the orientation of various elements in the FIGURES. It should be noted that the orientation of various elements may differ according to other exemplary embodiments, and that such variations are intended to be encompassed by the present disclosure.

It is important to note that the construction and arrangement of the firearm as shown in the various exemplary embodiments is illustrative only. Although only a few embodiments have been described in detail in this disclosure, many modifications are possible (e.g., variations in sizes, dimensions, structures, shapes and proportions of the various elements, values of parameters, mounting arrangements, use of materials, colors, orientations, etc.). For example, the position of elements may be reversed or otherwise varied and the nature or number of discrete elements or positions may be altered or varied. Accordingly, all such modifications are intended to be included within the scope of the present disclosure. Other substitutions, modifications, changes, and omissions may be made in the design, operating conditions and arrangement of the exemplary embodiments without departing from the scope of the present disclosure.

What is claimed is:

1. A bolt carrier group for a firearm, the bolt carrier group comprising:

a bolt carrier comprising:

a medial portion defining a top surface;

a first outer portion on a first side of the medial portion; and a second outer portion on a second side of the medial portion opposite the first side;

wherein the bolt carrier is configured to slidably couple with a first elongated member at the first outer portion and a second elongated member at the second outer portion;

a bolt received within an inner volume of the bolt carrier; and a cam pin coupled with the bolt, the cam pin positioned at least partially within the inner volume of the bolt carrier and extending through the top surface of the bolt carrier;

wherein the cam pin and the bolt are translatable and pivotable relative to the bolt carrier between a first position and a second position, and wherein the cam pin is configured to engage a recess of the second outer portion of the bolt carrier when in the first position, and further comprising a cam pin guide, wherein the cam pin guide is fixedly coupled with a receiver assembly and comprises a track configured to receive the cam pin to guide the cam pin between the first position and the second position as the bolt carrier translates along the first elongated member and the second elongated member relative to the cam pin guide.

2. The bolt carrier group of claim 1, wherein the cam pin is configured to interlock with the recess of the second outer portion of the bolt carrier when in the first position at an orientation different than an orientation of the cam pin when in the second position.

3. The bolt carrier group of claim 1, wherein the cam pin is configured to rotate and translate relative to the bolt carrier to position the cam pin at a front portion of the inner volume of the bolt carrier when in the second position.

4. The bolt carrier group of claim 1, wherein the first elongated member and the second elongated member are spaced apart so that the second elongated member does not obstruct the cam pin when the cam pin is in the first position and engages the recess of the second outer portion.

5. The bolt carrier group of claim 1, wherein the cam pin guide extends in a direction parallel with the first elongated member and the second elongated member and extends over the medial portion of the bolt carrier and the top surface of the bolt carrier.

6. The bolt carrier group of claim 1, wherein the cam pin is fixedly coupled with the bolt so that the bolt and the cam pin translate and rotate relative to the bolt carrier in unison.

7. The bolt carrier group of claim 1, wherein the bolt carrier and the bolt comprise steel.

8. A bolt carrier group for a firearm, the bolt carrier group comprising:

a bolt carrier comprising:

a medial portion;

a first outer portion; and a second outer portion;

wherein the bolt carrier is configured to slidably couple with a first elongated member at the first outer portion and a second elongated member at the second outer portion;

a bolt received within an inner volume of the bolt carrier; and a cam pin coupled with the bolt, the cam pin positioned at least partially within the inner volume of the bolt carrier and extending through a top surface of the bolt carrier;

wherein the cam pin and the bolt are translatable and pivotable relative to the bolt carrier between a first position and a second position, and wherein the cam pin is configured to engage a recess of the second outer portion of the bolt carrier when in the first position;

wherein the second elongated member comprises a notch configured to receive the cam pin when the cam pin is in the first position.

9. The bolt carrier group of claim 8, wherein the notch of the second elongated member is configured to align with a recess of the second outer portion of the bolt carrier when the bolt carrier is at a first position along the first elongated member and the second elongated member.

10. A bolt carrier group for a firearm, the bolt carrier group comprising:

a bolt carrier comprising:

a medial portion;

a first outer portion; and a second outer portion;

wherein the bolt carrier is configured to slidably couple with a first elongated member at the first outer portion and a second elongated member at the second outer portion;

a bolt received within an inner volume of the bolt carrier; and a cam pin coupled with the bolt, the cam pin positioned at least partially within the inner volume of the bolt carrier and extending through a top surface of the bolt carrier;

wherein the cam pin and the bolt are translatable and pivotable relative to the bolt carrier between a first position and a second position, and wherein the cam pin is configured to engage a recess of the second outer portion of the bolt carrier when in the first position;

wherein the second elongated member comprises one or more grooves extending along at least a portion of an entire length of the second elongated member, the one of the one or more grooves configured to receive the cam pin when the cam pin is in the first position and engages the recess of the second outer portion.

11. The bolt carrier group of claim 10, wherein the first elongated member comprises one or more grooves extending along at least a portion of an entire length of the first elongated member.

12. A firearm comprising a bolt carrier group, the bolt carrier group of the firearm comprising:

a bolt carrier comprising:

a medial portion defining a top surface;

a first outer portion on a first side of the medial portion; and a second outer portion on a second side of the medial portion opposite the first side;

wherein the bolt carrier is slidably coupled with a first elongated member at the first outer portion and a second elongated member at the second outer portion;

a bolt received within an inner volume of the bolt carrier; and a cam pin coupled with the bolt, the cam pin positioned at least partially within the inner volume of the bolt carrier and extending through the top surface of the bolt carrier;

wherein the cam pin and the bolt are translatable and pivotable relative to the bolt carrier between a first position and a second position, and wherein the cam pin engages a recess of the second outer portion of the bolt carrier when in the first position, and further comprising a cam pin guide, the cam pin guide fixedly coupled with a receiver assembly and comprising a track that receives the cam pin to guide the cam pin between the first position and the second position as the bolt carrier translates along the first elongated member and the second elongated member relative to the cam pin guide, the cam pin guide extending in a direction parallel with the first elongated member and the second elongated member and extending over the medial portion of the bolt carrier and the top surface of the bolt carrier.

13. The firearm of claim 12, wherein the cam pin interlocks with the recess of the second outer portion of the bolt carrier when in the first position at an orientation different than an orientation of the cam pin when in the second position.

14. The firearm of claim 12, wherein the cam pin rotates and translates relative to the bolt carrier to position the cam pin at a front portion of the inner volume of the bolt carrier when in the second position.

15. The firearm of claim 12, wherein the first elongated member and the second elongated member are spaced apart so that the second elongated member does not obstruct the cam pin when the cam pin is in the first position and engages the recess of the second outer portion.

16. A firearm comprising a bolt carrier group, the bolt carrier group of the firearm comprising:

a bolt carrier comprising:

a medial portion;

a first outer portion; and a second outer portion;

wherein the bolt carrier is slidably coupled with a first elongated member at the first outer portion and a second elongated member at the second outer portion;

a bolt received within an inner volume of the bolt carrier; and a cam pin coupled with the bolt, the cam pin positioned at least partially within the inner volume of the bolt carrier and extending through a top surface of the bolt carrier;

wherein the cam pin and the bolt are translatable and pivotable relative to the bolt carrier between a first position and a second position, and wherein the cam pin engages a recess of the second outer portion of the bolt carrier when in the first position;

wherein the second elongated member comprises a notch receiving the cam pin when the cam pin is in the first position, wherein the notch of the second elongated member aligns with a recess of the second outer portion of the bolt carrier when the bolt carrier is at a first position along the first elongated member and the second elongated member.

17. A firearm comprising a bolt carrier group, the bolt carrier group of the firearm comprising:

a bolt carrier comprising:

a medial portion defining a top surface;

a first outer portion on a first side of the medial portion; and a second outer portion on a second side of the medial portion opposite the first side;

wherein the bolt carrier is slidably coupled with a first elongated member at the first outer portion and a second elongated member at the second outer portion;

a bolt received within an inner volume of the bolt carrier; and a cam pin coupled with the bolt, the cam pin positioned at least partially within the inner volume of the bolt carrier and extending through the top surface of the bolt carrier;

wherein the cam pin and the bolt are translatable and pivotable relative to the bolt carrier between a first position and a second position, and wherein the cam pin engages a recess of the second outer portion of the bolt carrier when in the first position, wherein the second elongated member comprises one or more grooves extending along at least a portion of an entire length of the second elongated member, the one of the one or more grooves of the second elongated member receiving the cam pin when the cam pin is in the first position and engaging the recess of the second outer portion, the first elongated member comprising one or more grooves extending along at least a portion of an entire length of the first elongated member.

* * * * *